United States Patent [19]

Jasper, Jr.

[11] Patent Number: 4,753,153

[45] Date of Patent: Jun. 28, 1988

[54] ELECTROMAGNETIC RAILGUN WITH A NON-EXPLOSIVE MAGNETIC FLUX COMPRESSION GENERATOR

[75] Inventor: Louis J. Jasper, Jr., Ocean, N.J.

[73] Assignee: The United States of America as represented by the Secretary of the Army, Washington, D.C.

[21] Appl. No.: 934,273

[22] Filed: Nov. 24, 1986

[51] Int. Cl.[4] ..... F41F 1/02

[52] U.S. Cl. ..... 89/8; 124/3; 310/12; 318/135

[58] Field of Search ..... 89/8; 124/3; 310/10, 310/11, 12, 13, 14; 318/135

[56] References Cited

U.S. PATENT DOCUMENTS 3,126,789 3/1964 Meyer ..... 89/8

4,369,691 1/1983 Baehr et al. ..... 89/8

OTHER PUBLICATIONS

Foley et al., Compensated Pulsed Alternator, Lawrence Livermone National Laboratory, LLL-TB-23, 1980.

LA-5890-MS, "An Introduction To Explosive Magnetic Flux Compression Generators", issued Mar. 1975, by C. M. Fowler, R. S. Caird, W. B. Garn.

*Primary Examiner*—Stephen C. Bentley

*Attorney, Agent, or Firm*—Sheldon Kanars; John T. Rehberg

[57] ABSTRACT

A lightweight, portable, electromagnetic railgun. The invention features a conventional railgun coupled to a magnetic flux compression generator (MFCG) section and an injector section. The conventional railgun has two parallel metallic rails (13,15) with a bullet (25) slidably positioned between them. The bullet is rapidly projected between the rails toward a chosen target when a current flows between the rails (and through the bullet). The MFCG section provides a source of high current to the rails. The MFCG section has a piston (73) which moves between two energized bars (51,53). A magnetic field is created by current flowing in a circuit through the piston, (73) the bars (51,53) and the bullet (25). The associated magnetic flux is rapidly compressed as the piston moves between the bars. Compression of the magnetic flux produces a large current pulse which is coupled to the rails (13,15) to propel the bullet (25). The injector section injects the piston (73) into the space between the bars (51,53) to begin the magnetic flux compression sequence.

7 Claims, 5 Drawing Sheets

ELECTROMAGNETIC RAILGUN WITH A NON-EXPLOSIVE MAGNETIC FLUX COMPRESSION GENERATOR

The invention described herein may be manufactured, used, and licensed by or for the Government for Governmental purposes without the payment to me of any royalties thereon.

TECHNICAL FIELD

This invention relates generally to railguns and more particularly to railguns which utilize the principle of magnetic flux compression to generate large current pulses for gun operation.

BACKGROUND OF THE INVENTION

Conventional guns and projectile launching weapons utilize the burning of chemical propellents to achieve high projectile velocities. In recent years there has been a renewed interest in projectile launchers which utilize electromagnetic energy. Generally speaking, electromagnetic launchers promise higher projectile velocities than launchers utilizing chemical propellants. A prior art design currently receiving considerable attention is the electromagnetic railgun. The electromagnetic railgun utilizes two long parallel rails capable of carrying a large current. A sliding, conducting armature is positioned between the two rails. The armature is adapted to slide between the two rails along their entire length. Application of a voltage across two ends of the two rails causes a large current pulse to flow through one rail, thence through the armature, and into the other rail. The current generates a magnetic field. The Lorentz force created by the interaction of the magnetic field with the current in the armature causes the armature to be rapidly propelled between the two rails in a direction away from the points of application of the voltage. The armature itself may be projected like a bullet at a target, or the armature may be used to push a bullet-type projectile at high velocity towards a chosen target and the armature ultimately slowed and retained with the device for future shots. A detailed discussion of the principles of operation of an electomagnetic railgun is contained in applicant's co-pending application, titled "Electromagnetic Injector/Railgun," Ser. No. 910,915, Filed, Sept. 22, 1986, the entire disclosure of which is hereby incorporated by reference. To achieve high projectile velocities, large currents must be provided to the rails of the railgun. It is estimated that a current of at least 225 kiloAmperes (kA) is required to accelerate a two gram projectile to a velocity of 2 kilometers per second in a railgun of 1 meter length. The total weight of such a system is estimated to be between 150 and 200 pounds. The great weight of such a system makes the design of a hand-held railgun problematic.

SUMMARY OF THE INVENTION

It is an object of the present invention to provide a gun which does not require a chemical propellant.

It is another object of the present invention to provide a simple, compact electromagnetic projectile launcher.

A further object of the present invention is to provide a lightweight electomagnetic projectile launcher capable of launching projectiles at high speeds.

A still further object of the present invention is to provide a lightweight electomagnetic projectile launcher which utilizes high currents produced by magnetic flux compression.

An additional object of the present invention is to provide a hand-held gun which does not require chemically-propelled bullets.

The present invention has three sections: a railgun section, a magnetic flux compression generator section, and an injector section. The railgun operates, as previously described, by utilizing a large current to drive an armature at high speed between two parallel rails. The armature is the bullet or portion of the bullet which is directed toward a chosen target. The magnetic flux compression generator (MFCG) section utilizes the principal of magnetic flux compression to provide a large current pulse to energize the rails and propel the armature.

In the MFCG section, a conducting piston slides between two conducting bars. A voltage is applied across the bars. Current flows in a circuital path through the piston, through one bar, through the bullet and finally through the other bar. The current generates a magnetic field and a resultant magnetic flux in the area enclosed by the current's circuital path. The piston compresses the magnetic flux ahead of it as it slides forward between the bars. The bars are electrically connected to the rails. According to the laws of electrodynamics, magnetic flux compression produces a large current pulse which travels from the bars to the rails.

The injector section serves to inject the piston into the area between the bars, causing the piston to slide between them and produce the aforementioned magnetic flux compression. The injector section also provides the aforementioned voltage which is applied across the bars. The injector section is powered by a prime voltage source such as a battery and capacitor bank. The injector section utilizes the operative principles disclosed in the aforementioned co-pending application. Briefly, the injector section features two parallel circular disks arranged at right angles to the aforementioned bars and rails. The disks are electrically connected to the capacitor bank so that they may carry current in opposite directions. The disks are separated by an insulator. One of the disks has a gap sized to admit the piston. Application of a voltage via the capacitor bank to the disks, causes current to flow in opposite directions through the disks and causes the piston to be rapidly injected into the magnetic flux compression generator section. As mentioned before, movement of the piston through the magnetic flux compression generator section generates a large current pulse which causes a bullet to travel rapidly between the rails and thence towards a target.

BRIEF DESCRIPTION OF THE DRAWINGS

The invention will be more fully appreciated from the following detailed description when the same is considered in connection with the accompanying drawings, in which.

DETAILED DESCRIPTION OF THE PREFERRED EMBODIMENT

Figure 1:
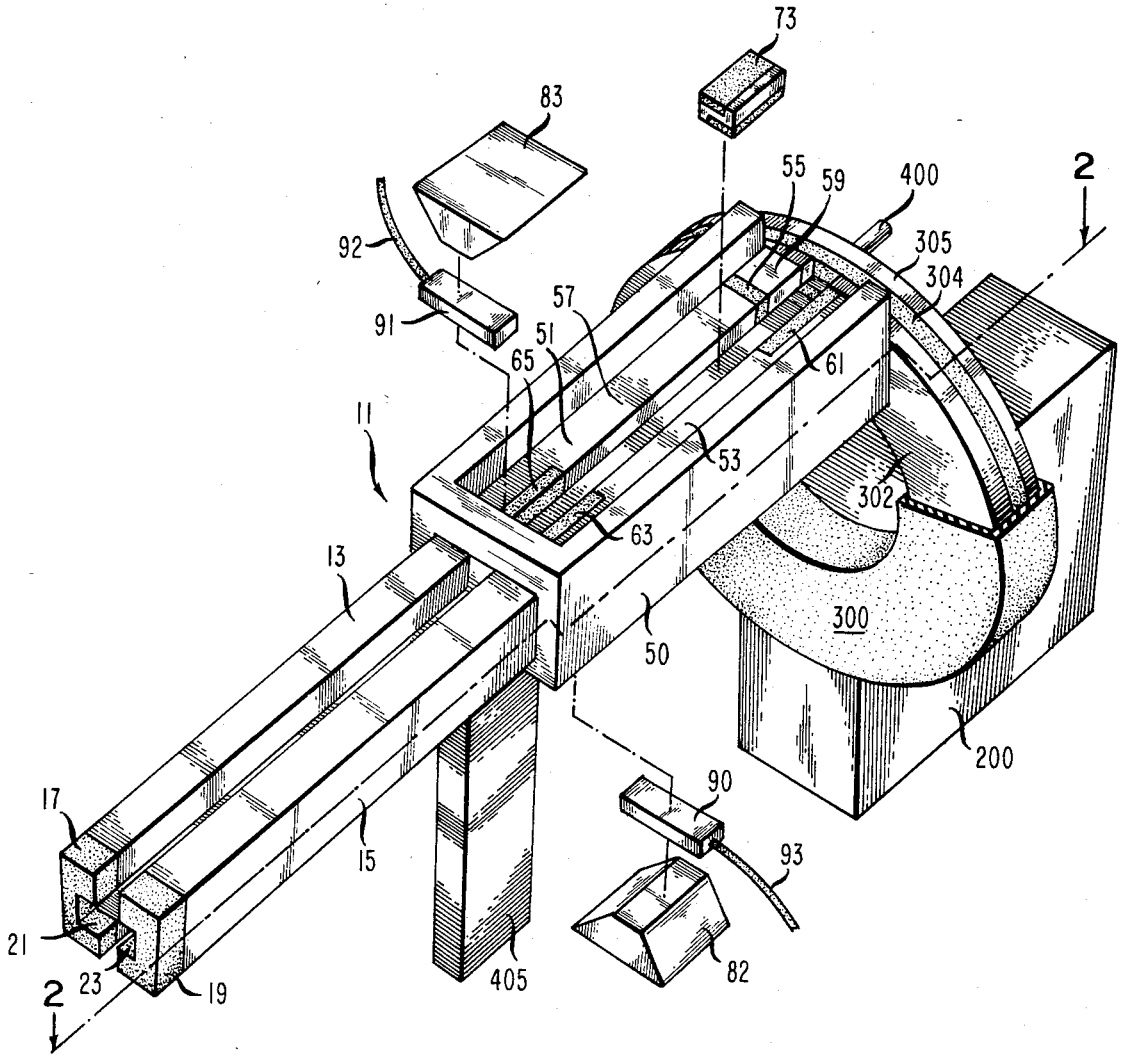
FIG. 1 is schematic perspective view of the inventive device.

Referring to the drawings, and more particularly to FIG. 1, wherein like numerals refer to like components throughout, reference numeral 11 designates generally the inventive device. The railgun section of the inventive device includes parallel metallic rails 13 and 15. Grooves 21 and 23 extend along the length of rails 13 and 15 respectively. The grooves 21 and 23 serve to guide the bullet 25 (shown in FIG. 2) as it accelerates between the rails toward the target. Although FIG. 1 discloses rectangular shaped grooves, other shapes, such as circular cross-sectional grooves, are acceptable. The only requirement is that the bullet 25 fit closely between rails 13 and 15. In a preferred embodiment, rails 13 and 15 are made of copper, or a copper alloy such as copper-tungsten. Snubbers 17 and 19 are positioned at the ends of rails 13 and 15. The purpose of the snubbers is to attenuate current remaining on the rails after the bullet leaves the railgun and also to reduce the signature of the railgun. Consequently, the snubbers are made from materials having a much higher resistivity than copper (or whatever other material the rails are made from). The bullet 25 (shown in FIG. 2) has a header section 29 and a body 27. The header 29 has a curved shape which facilitates progress of the bullet between the rails 13 and 15 and also improves the aerodynamic characteristics of the bullet 25 after it leaves the railgun. The body section 27 of the bullet 25 is metallic and has a cross-section which mates closely with grooves 21 and 23.

The general principles of railgun operation are well known to those skilled in the art and are also discussed in the above-mentioned co-pending application of the present inventor. Briefly, application of a voltage between rails 13 and 15 causes a large current to flow through rail 13, through the body section 27 of bullet 25, and thence through rail 15. Interaction between the aforementioned current and its self-generated magnetic field produces a Lorentz force which accelerates the bullet 25 between the rails 13 and 15 in a direction away from the points of application of the voltage. In the present invention, the large current required to drive bullet 25 between rails 13 and 15 toward the target is provided by the magnetic flux compression generator (MFCG) section.

The MFCG section is contained within housing 50. The housing 50 is made from insulating material. Two parallel conducting bars 51 and 53 are positioned in housing 50. Bar 51 is electically connected to rail 13 and bar 53 is electrically connected to rail 15. In a preferred embodiment, the bars may be formed integral with their respective rails and the housing 50, made from an epoxy material, formed about the bars. Bar 51 is completely severed into two sections 57 and 59 by an insulator segment 55. Insulator 55 completely prevents current flow from section 59 of bar 51 to section 57 of bar 51. An insulator pad 61 is inserted into a recess in rail 53 generally opposite insulator 55. As can be seen from FIG. 2, insulating pad 61 does not prevent current flow through bar 53. Two additional insulating pads 63 and 65 are also inserted into recesses of bars 53 and 51 respectively near the railgun end of the MFCG housing 50. As can be seen from FIG. 2, insulating pads 63 and 65 do not prevent current flow through bars 53 and 51. Conducting piston 73 fits closely between bars 51 and 53.

Figure 3A:
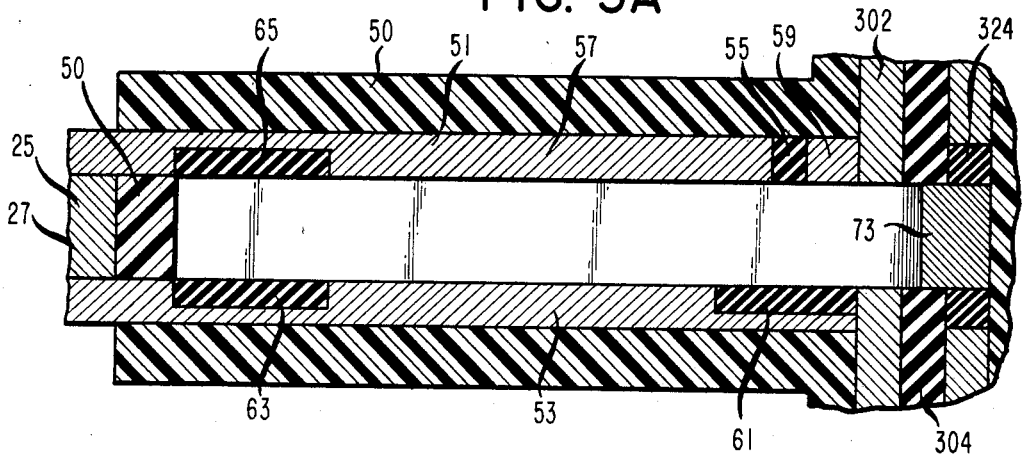
FIGS. 3A–3F are partial cross sectional views in the same plane as FIG. 2.
Figure 3B:
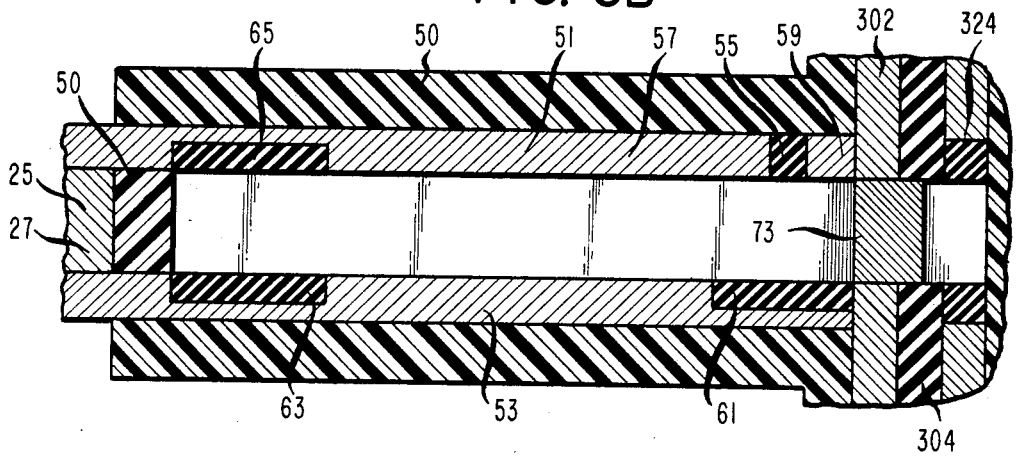
Figure 3C:
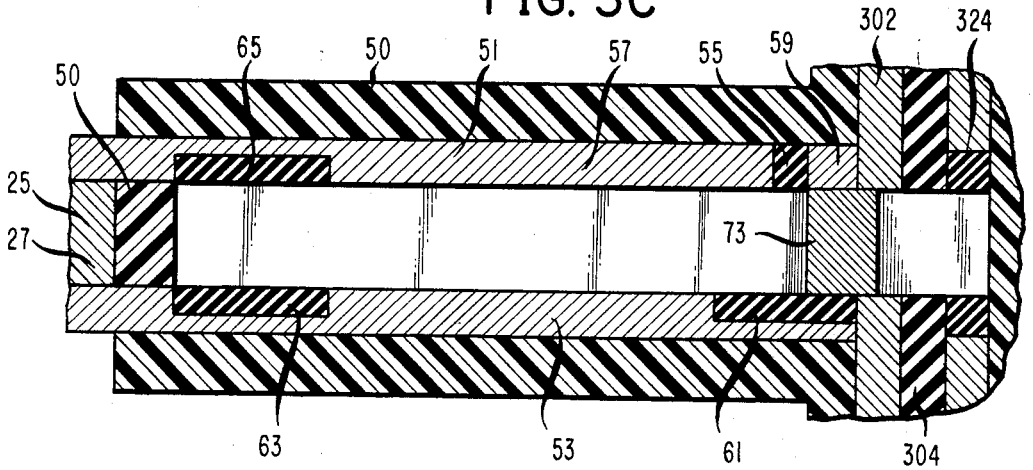

FIGS. 3A–F are plan cross-sectional views of the MFCG section which illustrate its operation. In FIG. 3A, piston 73 is at rest within the injector section (and bullet 25 is at rest between rails 13 and 15 in the railgun section). As will be described subsequently, the injector section, together with a push-catch mechanism serves to inject piston 73 between bars 51 and 53. The injector section also, as will be illustrated in further detail below, produces a voltage across bars 51 and 53, After the piston 73 is launched between bars 51 and 53, a magnetic field (and resultant magnetic flux) is created by the current flowing through the piston 73, bars 51 and 53, and bullet 25. As the piston 73 moves forward between bars 51 and 53, it compresses the magnetic flux trapped in the space interior to bars 51 and 53, piston 73 and bullet 25. Compression of the magnetic flux produces, according to the laws of electrodynamics, a large current pulse in bars 51 and 53. To explain more fully the principle of operation, consider the following sequence of events: The piston 73 in FIG. 3A is pushed to the position depicted in FIG. 3B by the yet-to-be described push-catch mechanism 400. In FIG. 3B piston 73 contacts disk 302 of the injector section. Presence of Piston 73 within the gap of disk 302 causes piston 73 to be forcibly ejected forward to the position depicted in FIG. 3C. Furthermore, as will be described in further detail below, bar 53 and bar section 59 of bar 51 are energized by application of a voltage from the injector section. (Of course, bar section 57 is *not* energized because insulator segment 55 prevents electrical contact between the two sections.) FIG. 3C illustrates the position of piston 73 as its front edge begins to contact insulator segment 55. A large current flows through disk 302, bar section 59, piston 73 and thence through the lower side of disk 302 while the piston 73 is in the position depicted by FIG. 3C.

Figure 3D:
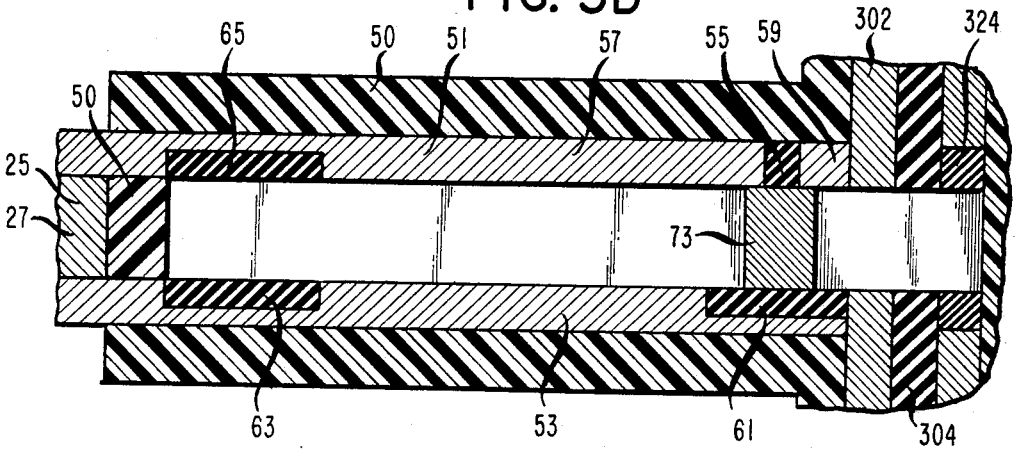

FIG. 3D illustrates the MFCG section as piston 73 begins to pass the location of insulator segment 55. It should be noted that the length of the piston is greater than the length of insulator segment 55. Because the piston is sized so that it is longer than insulator segment 55, current flows from disk 302 of the injector section through bar segment 59, thence through piston 73, through bar segment 57, through body 27 of the bullet and thence through rail 53 and lower side of disk 302, (and ultimately back to the power source to be discussed later). It is possible for current to effectively flow around insulator segment 55 as long as piston 73 straddles insulator segment 55. Furthermore, it should be noted that the length of piston 73 is *less* than the length of insulating pad 61 to ensure current flow in the above-described path.

Figure 3E:
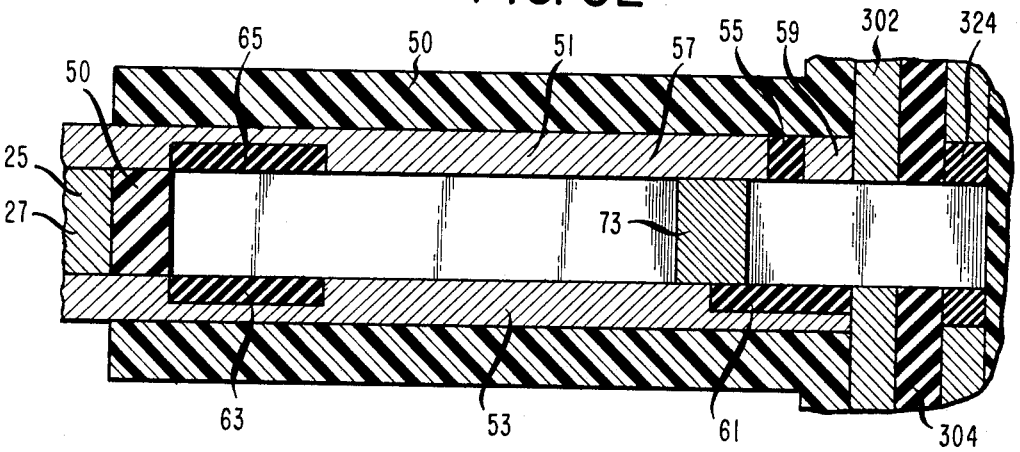

When piston 73 has reached the position depicted in FIG. 3E, it is effectively short-circuiting bars 51 and 53. Current flows through the circuital path consisting of piston 73, bar section 57, bullet 25, and bar 53. The circuital current flow creates a magnetic field, and hence a magnetic flux, perpendicular to the plane of the figure. As the piston 73 races forward to the position depicted in FIG. 3F, magnetic flux compression occurs.

A large current pulse is generated by compression of the magnetic flux by the forward-moving piston, moving at a sufficiently large velocity so as to prevent flux leakage. Because bars 51 and 53 are electrically connected to rails 13 and 15, the current pulse is applied to rails 13 and 15. As previously described, application of a large current to rails 13 and 15 caused acceleration of bullet 25 along rails 13 and 15 and thence toward the target. The MFCG section is thus responsible for producing the high currents necessary to achieve high bullet velocity. Operation of the MFCG section may be better understood by an examination of FIG. 4 in conjunction with FIGS. 3A–3F. FIG. 4 is a graph which illustrates the current flowing through the piston 73 as it reaches the various positions depicted by FIGS. 3A–3F. Points labelled A–F on the graph are roughly indicative of relative current magnitudes at the times when the piston 73 is in the positions depicted by FIGS. 3A–3F.

When piston 73 is at its starting position within the injector section as depicted in FIG. 3A, no current flows through the piston. Point A on the graph of FIG. 4 illustrates zero current through the piston. The Piston 73 is pushed forward by the push-catch mechanism 400. When the piston 73 contacts disk 302 of the injector section, as in FIG. 3B, current flows through disk 302 and piston 73 and, as will be elaborated further below, the piston 73 is forcibly ejected forward. Point B on the graph of FIG. 4 illustrates the relative current flowing through piston 73 as it reaches the position depicted in FIG. 3B. As the piston 73 moves forward to the position of FIG. 3C, it begins to contact insulator segment 55 and current through the piston 73 falls, as shown by point C in FIG. 4. In FIG. 3D, the piston 73 straddles insulator segment 55 and current through the piston 73 rises again as shown by point D of FIG. 4. In FIG. 3E, the current circuital path which sustains and traps magnetic flux is established through piston 73, bullet 25, and bars 57 and 53. Current through the piston (which is, of course, the same as current through the other components of the circuit) is depicted by point E of FIG. 4. As piston 73 continues to rush forward, the trapped magnetic flux is compressed and current continues to rise, as shown by FIG. 4. The same current is, of course, transmitted from bars 51 and 57 to rails 13 and 15 to operate the railgun. Finally, as piston 73 comes to rest between insulators 65 and 63, current *through the piston* 73 falls, as shown by point F of FIG. 4. Or course, although current through piston 73 has diminished, current continues to persist on rails 15 and 13 to drive bullet 25 toward its target.

The following few paragraphs will explain in somewhat greater detail the physical principles of magnetic flux compression. The MFCG section of the present invention does not require the use of chemical explosives—it is a non-explosive MFCG. Many prior art MFCG devices utilize chemical explosives. In general, chemical explosives are used to compress an initially established magnetic flux by collapsing part or all of a conducting surface which encompasses the flux. Work done by the conducting surfaces moving against the magnetic fields results in an increase in electro-magnetic energy. The energy is supplied by the chemical energy stored in the explosives, a part of which is transmitted to the moving conductors.

In a perfectly conducting (zero resistance) circuit, a well-known electrodynamic result is that the flux is conserved, or:

$$L_0 I_0 = L_F I_F$$

where $L_0$ and $I_0$ are the inductance and current respectively at time zero and $L_F$ and $I_F$ are respectively inductance and current at a subsequent time.

Explosive MFCGs have the ability to produce large energy bursts in time scales not normally available otherwise. Large current and energy multiplcations are thus possible for low inductance circuits. However, explosive generators destroy some system components and their use is limited to single shot or at best low repetition rate applications. A detailed discussion of explosive magnetic flux compression generators is contained in: C. M. Fowler, et al. "An Introduction to Explosive Magnetic Flux Compression Generators, Los Alamos scientific laboratory report LA-5890-MS, dated March 1975".

The MFCG of the present invention does not, of course, use chemical explosives. The yet-to-be-described injector section of the present invention accellerates piston 73 until it arrives at the position depicted in FIG. 3E. The magnetic flux enclosed by the current path shown in FIG. 3E is rapidly compressed by the accelerating piston 73 as it travels toward its resting place depicted in FIG. 3F. The conservation of flux equation gives the current $I_F$ increase since the inductance $L_F$ decreases as the circuit area enclosing the flux decreases. The faster piston 73 moves, the more current gained, because the circuit area will decrease more rapidly before bullet 25 accelerates and in turn causes the circuit area to increase. Also, the flux leakage is minimized by rapid piston velocity. The MFCG section of the present invention is designed to produce energy and current gains in the range of 5 to 10.

Note, that for a rail gun, the force equation is $$F = \tfrac{1}{2} L' I^2$$

where $L^1$ is the inductance gradient and is I the current. The force increases linearly with inductance and with the square of the current. This means that a MFCG that yields only current gain and no energy gain is still beneficial because a larger Lorentz force will be generated. The condition of current gain and no energy gain means that the efficieny of the device has been increased. An advantage of the present non-explosive MFCG is that the device may be used over and over again to yield multiple bullet shots. A subsequent portion of this disclosure will explain how the piston 73 is returned to its starting point for subsequent shots. Of course, the present non-explosive MFCG does not produce energy or current gains as great as those provided by explosive MFCGs. Somewhat lower gains are anticipated for the present inventive device mainly because the electrically driven piston does not move as fast as an explosively driven piston. An estimate minimum piston velocity is about 300 m/sec.

Figure 3F:
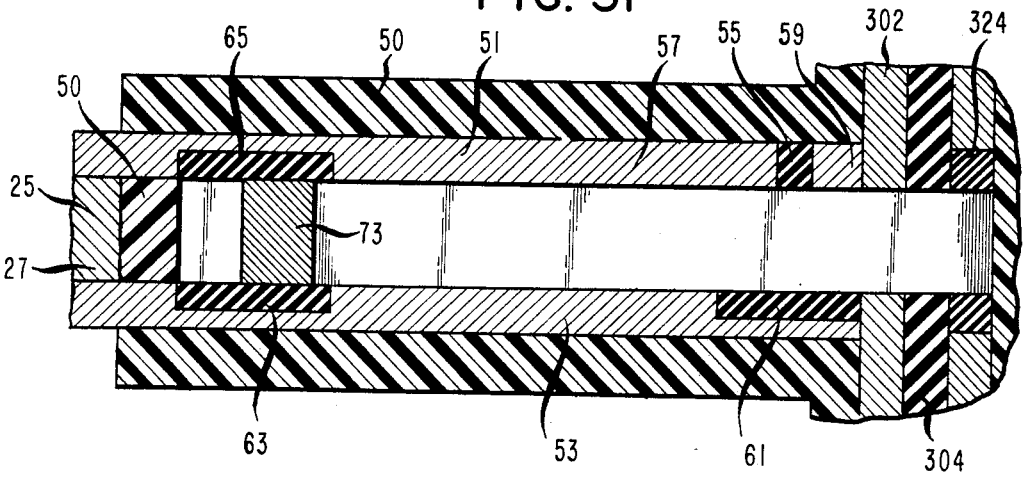
Figure 4:
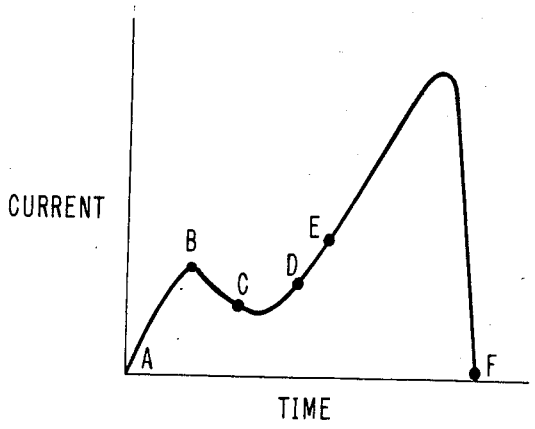
FIG. 4 is a graph which qualititively illustrates the time dependence of current in the magnetic flux compression generator section.

FIG. 3F depicts the piston 73 as it comes to the end of its path between rails 51 and 53. Insulating pads 63 and 65 serve to prevent current flow, and the piston 73 comes to a stop due to magnetic braking action. Forward progress of piston 73 is also halted, if necessary, by housing 50. For maximum efficiency, piston 73 should just come to rest.

If current flows in the counter clock-wise direction depicted in FIG. 3D, the resulting magnetic field will point upward from the plane of the figure. The upward-pointing magnetic field depicted in FIG. 3D may be augmented by two permanent magnets 83 and 82 (FIG. 1), which may be placed above and below the MFCG section. The magnets 83 amd 82 must be oriented to create a magnetic field in the same direction as the magnetic field depicted in FIG. 3D, i.e. pointing upward in FIGS. 1 and 3D for current flow in the counter clockwise direction. Should the magnetic field created by permanent magnets 82 and 83 be accidently oriented in a direction opposed to the magnetic field created by the current, the permanent magnets 82 and 83 will be degaussed and be of no use.

The permanent magnets 82 and 83 serve to augment the magnetic field created by current flowing in bars 51 and 53. Magnets 82 and 83 may be made from samarium cobalt, neodmium-iron-boron or another high energy product magnet material. If magnets 82 and 83 are spaced approximately one-half inch or less between their pole pieces, approximately 1.5 to 2.0 Teslas may by produced. Thus, the permanent magnets 82 and 83 contribute a magnetic field roughly equivalent to the magnetic field generated at the surface of an infinitely long wire carrying 50 kiloAmperes of current. The permanent magnets 82 and 83 thus augment the magnetic flux between bars 51 and 53 and therefore increase the resulting current pulse produced. The magnets shown schematically in FIG. 1 extend over only a portion of the magnetic flux compression area between bars 51 and 53. However, it is possible, if desired, to make magnets 82 and 83 longer to cover the entire MFCG section. Magnets with extended length have the disadvantage of heavier weight but provide the advantage of greater magnetic field augmentation between rails 51 and 53 and consequent greater Lorentz Force.

Figure 2:
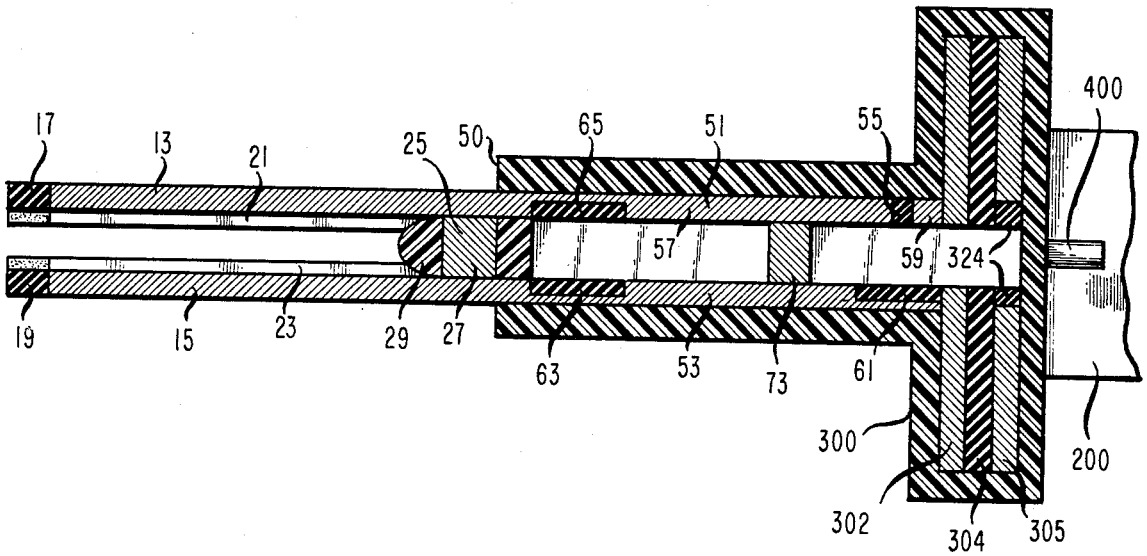
FIG. 2 is a plan cross-sectional view of the device of FIG. 1 cut along the line 2—2 looking in the direction of the arrows.
Figure 6:
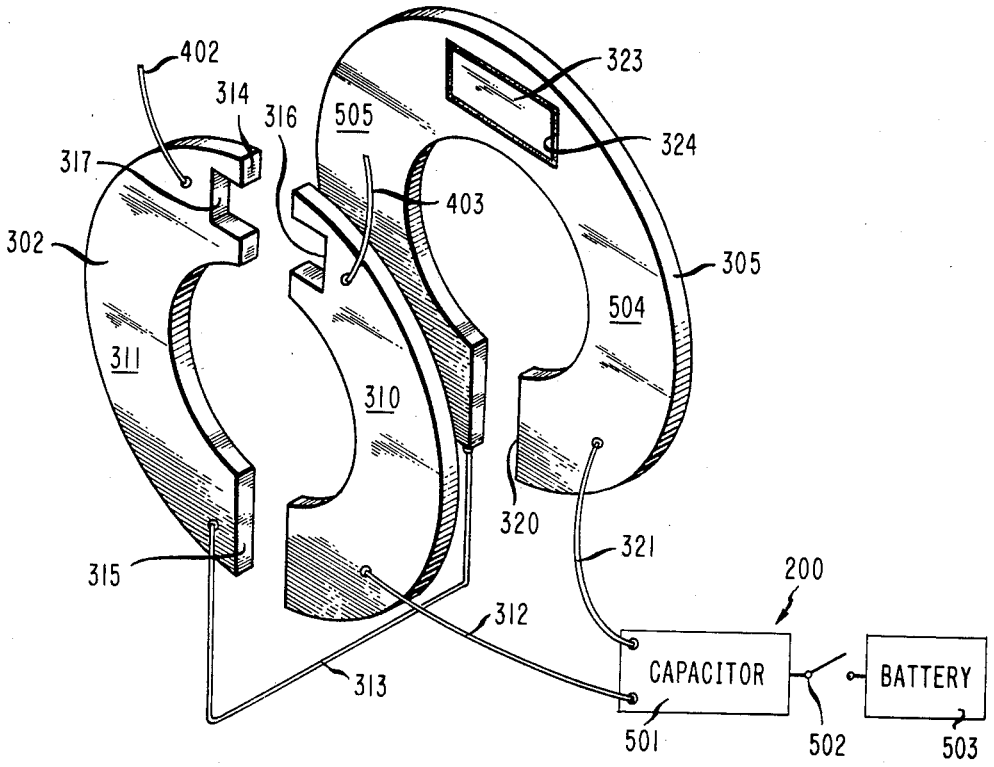
FIG. 6 is a schematic perspective view of the principal components of the injector section of the inventive device.

Thus, what has been described so far is the railgun section of the present inventive device which propels a bullet toward a chosen target with the application of a large current pulse to its rails 13 and 15. The current pulse necessary to energize the railgun is provided by the non-explosive MFCG which utilizes piston 73 injected between bars 51 and 53 to compress a resulting magnetic flux and provide the needed current pulse. Piston 73 is initially launched at high speed between bars 51 and 53 by the injector section which is described below:

The injector section is most easily understood by reference to FIGS. 1, 2, and 6. The injector section of the present invention utilizes the electromagnetic principle that oppositely directed currents flowing in parallel conductors tend to force those conductors apart. Briefly, disks 302 and 305 are oriented parallel to each other, separated by an insulator 304. The disks 302 and 305 are arranged so that current from a battery/capacitor bank 200 flows in opposite directions through them. Piston 73, originally at rest within an insulated gap 323 in disk 305 is ejected by a push-catch mechanism 400 into a gap in disk 302. Presence of the piston within the gap in disk 302 permits current to flow through both disks and causes the piston 73 to be ejected between rails 51 and 53.

Figure 5A:
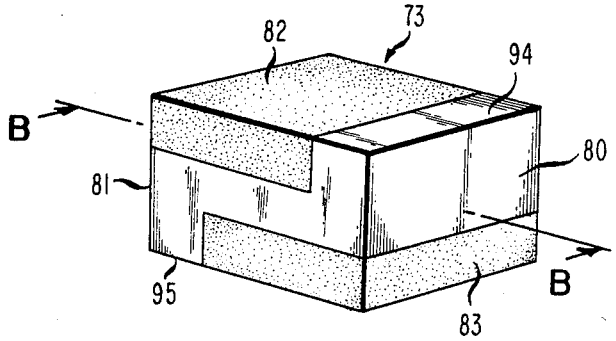
FIG. 5A is an enlarged perspective view of the piston of the magnetic flux compression generator.
Figure 5B:
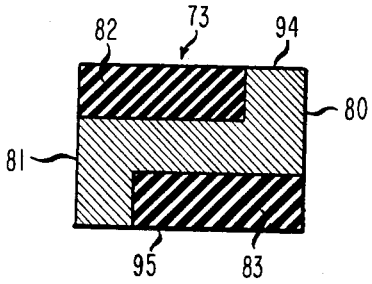
FIG. 5B is a cross-sectional view of the piston of FIG. 5A, cut along the line B—B looking in the direction of the arrows.

Disk 302 is generally circular in shape. Disk 302 is split in two halves 310 and 311 by gaps 314 and 315. Disk 305 is split by gap 320 into two halves 505 and 504. Connector 313 connects the lower portion of half-disk 311 and the lower portion of half-disk 505. Connector 312 is attached to the lower portion of half-disk 310 and connector 321 is attached to the lower portion of half-disk 504. Notches 317 and 316 are located adjacent gap 314 and disk halves 311 and 310 respectively. Notches 317 and 316 are shaped and spaced apart so that piston 73 fits closely within them. It is necessary that piston 73 fit closely enough that it forms an electrical connection for the conduction of current between the disk half 310 through piston 73 to disk half 311. For example, side 81 of piston 73 (FIG. 5) touches notch 317 and side 80 of piston 73 touches notch 316.

Disk 305 is split by gap 320 at its bottom. A hole 323 is located in the top of disk 305. The hole 323 does *not* sever disk 305, i.e., it is possible for current to flow through the disk material above and below hole 323. Hole 323 is defined on all sides by an insulating insert 324. Hole 323 is dimensioned to closely receive piston 73. However, the presence of insulating insert 324 prevents any current which may flow through disk 305 from flowing through piston 73.

Insulator 304 has the same circular dimentions as disks 305 and 302 and is sandwiched between them. Insulator 304 has a hole through which piston 73 may pass as it travels from disk 305 through disk 302. Except for the hole, there need be no other gaps or holes in insulator 304.

In operation, leads 312 and 321 are connected to opposite sides of a capacitor bank/battery combination 200. The capacitor bank is denotd by reference numeral 501; the battery or other power supply by numeral 503. A trigger switch 502 is positioned between them. Piston 73 is inititally at rest within hole 323 of disk 305. The piston 73 must be short enough so that it does not protrude into or contact any portion of disk 302. Consequently, thickness of disk 305 plus the thickness of insulator 304 must equal or exceed the length of piston 73. Push-catch mechanism 400 contains an actuator which may be electrically or mechanically powered. The actuator serves to push the piston 73 from its resting place in hole 323 into the gap defined by notches 317 and . 316 of disk 302. Presence of the piston 73 within the gap defined by notches 317 and 316 of 302 causes current to flow through disks 302 and 305 in opposite directions. The sandwich of disks 305 and 302 and insulator 304 is firmly held together within an epoxy coating 300. Consequently, disks 305 and 302 cannot move apart despite the strong force created by the oppositely-moving currents. Piston 73 is forcibly ejected from the space defined by notches 317 and 316 to a position between bar 59 and 53 as shown in FIG. 3C. Disk half 310 is electrically connected to rail 53 and they may be formed integrally if desired. Disk half 311 is electrically connected to bar segment 59 and they may be formed integrally if so desired. Operation of the magnetic flux compression generator section after piston 73 has been ejected into the position depicted in FIG. 3C and the ultimate ejection of bullet 25 have already been described.

After piston 73 finally arrives at a position depicted in FIG. 3E between insulating pads 63 and 65, current generation ceases. It is necessary to somehow return piston 73 to its starting place within hole 323 of disk 305 so that another bullet may be fired. The following paragraphs describe how piston 73 is returned to its starting position in anticipation of the next shot. Piston 73, shown in enlarged detail in FIG. 5, has two insulating inserts 82 and 83 located in sides 80 and 81 respectively. In forward-operation, such as is depicted in FIGS. 3A–3F, current flows through piston 73 from side 81 to side 80. Side 81 of piston 73 is contiguous to the side of bar 51 and side 80 is contiguous to the corresponding side of bar 53. However, when piston 73 arrives between insulating pads 63 and 65, the insulating pads prevent current from flowing between the sides of the bars and the sides 80 and 81 of piston 73. However, magnets 83 and 82 together with metal plates 91 and 90 are utilized to create a Lorentz force which serves to return piston 73 to its starting position in hole 323 of disk 305. Plates 90 and 91 are positioned above and below the plane of FIG. 3E. Plate 91 is positioned so that it contacts the top surface 94 of piston 73. Plate 90 is positioned so that it contacts the bottom surface 95 of piston 73. Leads 92 and 93 are attached to plates 91 and 90 respectively. Plates 90 and 91 are located within the gap between the pole pieces of magnets 82 and 83. Leads 92 and 93 are connected to leads 402 and 403 of disk 302. Leads 92 and 93 are twisted together as they extend from disk 302 to plates 91 and 90 so that the repulsive forces exerted on the wires are reduced. When piston 73 comes to rest at the position shown schematically in FIG. 3E, the top of piston 73 contacts plate 91 and the bottom of piston 77 comes in contact with plate 90. The leads 92 and 93 are connected so that current flows through the piston 73 from the top surface 94, in the general direction from side 80 to 81, and thence through bottom surface 95, into plate 90. It should be observed, that the principle direction of *horizontal* current flow through piston 73 caused by contact with plates 91 and 90 is *opposite* to the direction of current flow depicted in the forward-moving snapshot of FIG. 3D. The portion of the current through piston 73 which is parallel to the magnetic fields between magnets 82 and 83 does not contribute to a Lorentz force capable of returning the piston 73. However, the horizontal component of current flow, proceeding generally from side 80 to side 81 interacts with the magnetic field created by permanent magnets 82 and 83 to produce a Lorentz force which pushes the piston backward towards its starting position in hole 323 of disk 305. Thus, the piston 73 is returned to its initial starting point from whence it may begin another cycle.

The push catch mechanism 400 is not shown in detail and is well known in may arts. The functions of the push catch mechanism are twofold: to push the piston 73 from its initial position in hole 323 of disk 305 into the gap defined by notches 317 and 316 of disk 302, thus causing conduction through disk 302 and ejection of piston 73, and to catch and hold piston 73 after it is returned by the above-described Lorentz force return mechanism. As mentioned before, ejection of the piston 73 may be accomplished by a variety of actuators well known to those skilled in many arts, such as solenoid-actived actuators or spring-loaded actuators. The catching mechanism may be either a spring-loaded hook or an electromagnet.

Ammunition clip 405 is positioned generally beneath bullet 25. Ammunition clip 405 may be a spring-loaded clip selected from a variety of designs well-know to those skilled in the art. The purpose of the ammunition clip 405 is to provide additional bullets 25 for multiple shots. If desired, the ammunition clip may be accompanied by a sensor which prevents a new bullet from being inserted between rails 13 and 15 while the previous bullet is still traveling between them.

Performance of the inventive device may be enhanced by constructing housing 50 to be air tight. Such an assembly might require that magnets 82 and 83 be located outside housing 50 and might also require feed throughs for bars 51 and 53 and leads 92 and 93. The interior of housing 50 could be filled with an arc suppressing gas such as sulfur hexaflouride at a pressure of a few atmospheres. An alternative embodiment features a housing evacuated to a very low pressure on the order of $10^{-6}$ to $10^{-8}$ Torr. This embodiment would possess the advantages of reducing arcing between piston 73 and rails 51 and 53, providing less friction for moving piston 73 and, possibly allowing the use of superconducting metals or metal temperature reduction techniques to enhance efficiency and lower circuit resistence. If the inventive device were to be adapted for pod-mounted or vehicle-mounted applications, the use of a compact cryorefrigerator capable of reducing the temperature of the copper rails from room temperature to −140° C. would be feasible.

The inventive device may be fired by using a trigger. The trigger is connected to several of the aforementioned components of the inventive device. The trigger is connected to activate the push-catch mechanism 400, while simultaneously energizing disks 302 and 305 via switch 502.

The illustrative embodiment herein is merely one of those possible variations which will occur to those skilled in the art while using the inventive principles contained herein. Accordingly numerous variations of the invention are possible while staying within the spirit and scope of the invention as defined in the following claims.

What is claimed is:

1. A device for shooting a metallic pojectile comprising:

first and second parallel metallic rails spaced apart to closely receive said projectile between them;

first and second parallel conductive bars spaced apart and connected repectively to said first and second rails;

a piston dimensioned to closely slide in the said space between said bars;

first and second disks, parallel spaced apart, each of said disks having a periphery and a hole in its center and each of said disks having a gap extending from its said hole to its said periphery, the first of said disks having a second gap extending from its said hole to its said periphery, said second gap being dimensioned to closely receive said piston; and means for applying a voltage to said disks and said bars so that when said piston is within said second gap, current flows through both said disks in opposite directions causing said piston to be accelerated away from said disks and between said bars and said projectile is launched.

2. The device of claim 1 wherein said second disk has a hole in registration with said gap of said first disk; and further including an insulator insert within said hole, said insulator insert having a cavity dimensioned to closely receive said piston.

3. The device of claim 2 further including a disk-shaped insulator sandwiched between said first and second disks, said insulator having a gap sized to permit said pistion to pass freely from said second disk to said first disk.

4. The device of claim 3, further including:

a housing which encloses said bars; and first and second insulating pads inserted into respective said first and second bars.

5. The device of claim 4 in which said first bar is servered into two sections by an insulation segment and said second bar has a third insulating pad inserted therein, generally opposite said insulation segment.

6. The device of claim 5 further including:

first and second permanent magnets disposed respectively above and below said bars;

first and second plates positioned respectively above and below said bars, said plates being spaced apart to closely contact the top and bottom of said piston; and wherein said piston further includes first and second insulating pads covering respectively a portion of the said top and a portion of the said bottom of said piston, and further including means for applying a potential between said plates whereby presence of said piston between said plates causes a current to flow in a transverse direction through said piston.

7. A gun for shooting a metallic projectile comprising:

first and second parallel metallic rails spaced apart to closely receive said projectile between them;

first and second parallel matallic bars spaced apart and connected respectively to said first and second rails, said first bar being severed into two halves by an insulation segment, and said second bar having an insulating pad inserted therein, generally opposite said insulating segment;

first and second disks, parallel spaced apart, each of said disks having a periphery and a hole in its center and each of said disks having a gap extending from its said hole to its said periphery, the first of said disks also having a second gap extending from its hole to its periphery, said first and second gaps dividing said first disk into first and second halves, the first half of said first disk being connected to said first bar and the second half of said first disk being connected to said second bar;

a piston dimensioned to fit closely in the said space between said bars and adapted to slide between said bars along the length thereof, said piston having a top and a bottom, said top being partially covered by a top insulator and said bottom being partially covered by a bottom insulator, said top and bottom insulators serving to define a substantially transverse current path through said piston;

a housing enclosing said bars;

meaning for applying a voltage to said disks so that when said piston is within said second gap of said first disk current flows through both disks in opposite directions, causing said piston to be accelerated away from said disks into said space between said first and second bars, creating a current through said piston, said first bar, said projectile and said second bar and producing magnetic flux compression whereby a current pulse is applied to said first and second rails and said projectile is shot from between said rails;

first and second plates positioned respectively above and below said bars, said plates being spaced apart to closely contact the said top and the said bottom of said piston;

first and second permanent magnets disposed respectively above and below said first and second plates;

means for selectively applying a voltage to said piston whereby presence of said piston between said plates causes a current to flow in a transverse direction through said piston and said piston moves in a backwards direction between said bars in anticipation of the next shot.

* * * * *